US011203060B2

(12) United States Patent
Ikuta et al.

(10) Patent No.: US 11,203,060 B2
(45) Date of Patent: Dec. 21, 2021

(54) CASTING METHOD

(71) Applicant: TOYOTA JIDOSHA KABUSHIKI KAISHA, Toyota (JP)

(72) Inventors: Hiroyuki Ikuta, Nisshin (JP); Yoshikazu Abe, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/023,781

(22) Filed: Sep. 17, 2020

(65) Prior Publication Data

US 2021/0187601 A1 Jun. 24, 2021

(30) Foreign Application Priority Data

Dec. 19, 2019 (JP) ..... JP2019-228883

(51) Int. Cl.
*B22D 17/06* (2006.01)
*B22D 17/20* (2006.01)

(52) U.S. Cl.
CPC ..... *B22D 17/06* (2013.01); *B22D 17/2069* (2013.01)

(58) Field of Classification Search
CPC ..... B22D 17/00; B22D 17/06; B22D 17/08; B22D 17/10; B22D 17/2069; B22D 27/00; B22D 27/003; B22D 27/006; B22D 27/09; B22D 27/13
See application file for complete search history.

(56) References Cited

U.S. PATENT DOCUMENTS 4,085,791 A * 4/1978 Kaiser ..... B22D 17/14 164/473
2001/0030035 A1* 10/2001 Oda ..... B22F 3/26 164/100

FOREIGN PATENT DOCUMENTS

DE 10 2013 103 672 A1 10/2014
JP 2016-196009 A 11/2016
WO 2012/004192 A1 1/2012

* cited by examiner

*Primary Examiner* — Kevin P Kerns
*Assistant Examiner* — Steven S Ha
(74) *Attorney, Agent, or Firm* — Sughrue Mion, PLLC

(57) ABSTRACT

A casting method includes loading molten metal into a cavity from a sleeve, and sending a gas into the cavity from the outside of the cavity, except the sleeve, to pressurize a gas in the cavity and to increase the pressure value of the gas in the cavity to the atmospheric pressure or higher.

3 Claims, 10 Drawing Sheets

RELATED ART

CASTING METHOD

CROSS-REFERENCE TO RELATED APPLICATION

This application claims priority to Japanese Patent Application No. 2019-228883 filed on Dec. 19, 2019, incorporated herein by reference in its entirety.

BACKGROUND

1. Technical Field

The present disclosure relates to a casting method, and particularly, to a casting method in which molten metal is pressurized.

2. Description of Related Art

In the method for manufacturing a cast product disclosed in Japanese Unexamined Patent Application Publication No. 2016-196009, the front side of molten metal loaded in a cavity is locally pressurized by moving a squeeze pin in the cavity. This configuration is devised to suppress the generation of a blowhole.

SUMMARY

In a cast product, there is a part of a predetermined distance apart from a part that is pressurized by a squeeze pin. In such a distant part, a large blowhole is more often generated than in the pressurized part. That is, it is not possible to suppress the generation of a blowhole throughout the entire cast product. The fact that the pressure applied by the squeeze pin to molten metal is not transferred to the entire molten metal is considered as one possible cause for this impossibility.

The cross section shown in FIG. 11 is a cross section of a part of a predetermined distance apart from a part that is pressurized by the squeeze pin in a cast product SL9. A blowhole DF9 is generated in the cross section. The blowhole DF9 has a predetermined size, and there is a possibility that the mechanical strength of the cast product SL9 may decrease. Therefore, the blowhole DF9 is treated as a defect of the cast product SL9.

The present disclosure is intended to suppress the generation of a blowhole, which acts as a defect of cast products.

An aspect of the present disclosure relates to a casting method. The casting method includes loading molten metal into a cavity from a sleeve, and sending a gas into the cavity from the outside of the cavity, except the sleeve, to pressurize a gas in the cavity and to increase the pressure value of the gas in the cavity to the atmospheric pressure or higher.

This aspect incorporates the gas compressed to the atmospheric pressure or higher into the molten metal. When the molten metal solidifies, the incorporated gas expands to impart pressure to the molten metal. Therefore, even when large solidification shrinkage occurs during the solidification of the molten metal, the gas incorporated into the molten metal expands and compensates for pressure to be transferred to the molten metal. Therefore, since pressure can be applied to the entire molten metal, a number of holes are dispersed and miniaturized, and it is possible to suppress the generation of a blowhole, which acts as a defect in cast products.

In addition, in the aspect, increasing the pressure value of the gas in the cavity to the atmospheric pressure or higher may be started from a point in time at which a part of the molten metal passes through a gate after the loading of the molten metal into the cavity from the sleeve is started.

With the aspect, the gas starts to be sent into the cavity from the point in time at which the part of the molten metal passes through the gate. Therefore, since the pressure value of the gas in the cavity is the atmospheric pressure or higher at a point in time at which the molten metal reaches a product cavity, it is possible to reliably apply pressure to the molten metal.

In addition, in the aspect, the casting method may further include re-pressurizing the gas in the cavity to increase again the pressure value of the gas in the cavity to the atmospheric pressure or higher from a point in time at which the part of the molten metal reaches a re-pressurization start position positioned on the final loading portion side in the cavity after increasing the pressure value of the gas in the cavity to the atmospheric pressure or higher is executed.

With the aspect, it is possible to increase again the pressure of the gas in the cavity even when the gas in the cavity leaks through the joining surfaces of molds and the pressure decreases at a point in time at which the part of the molten metal passes through the gate and then reaches the re-pressurization start position.

In addition, in the aspect, in increasing the pressure value of the gas in the cavity to the atmospheric pressure or higher, the gas in the cavity may be pressurized by sending the gas from a position that is closer to the gate than the re-pressurization start position is.

With the aspect, since the gas is sent from the gate side of the re-pressurization start position, it is possible to pressurize the gas from a position close to the molten metal that has passed through the gate.

The present disclosure is capable of suppressing the generation of a blowhole, which acts as a defect of cast products.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, specific embodiments to which the present disclosure is applied will be described in detail with reference to drawings. The present disclosure is not limited to the following embodiment. In addition, the following description and drawings are simplified as appropriate for the sake of clarity.

Embodiment 1

Figure 1:
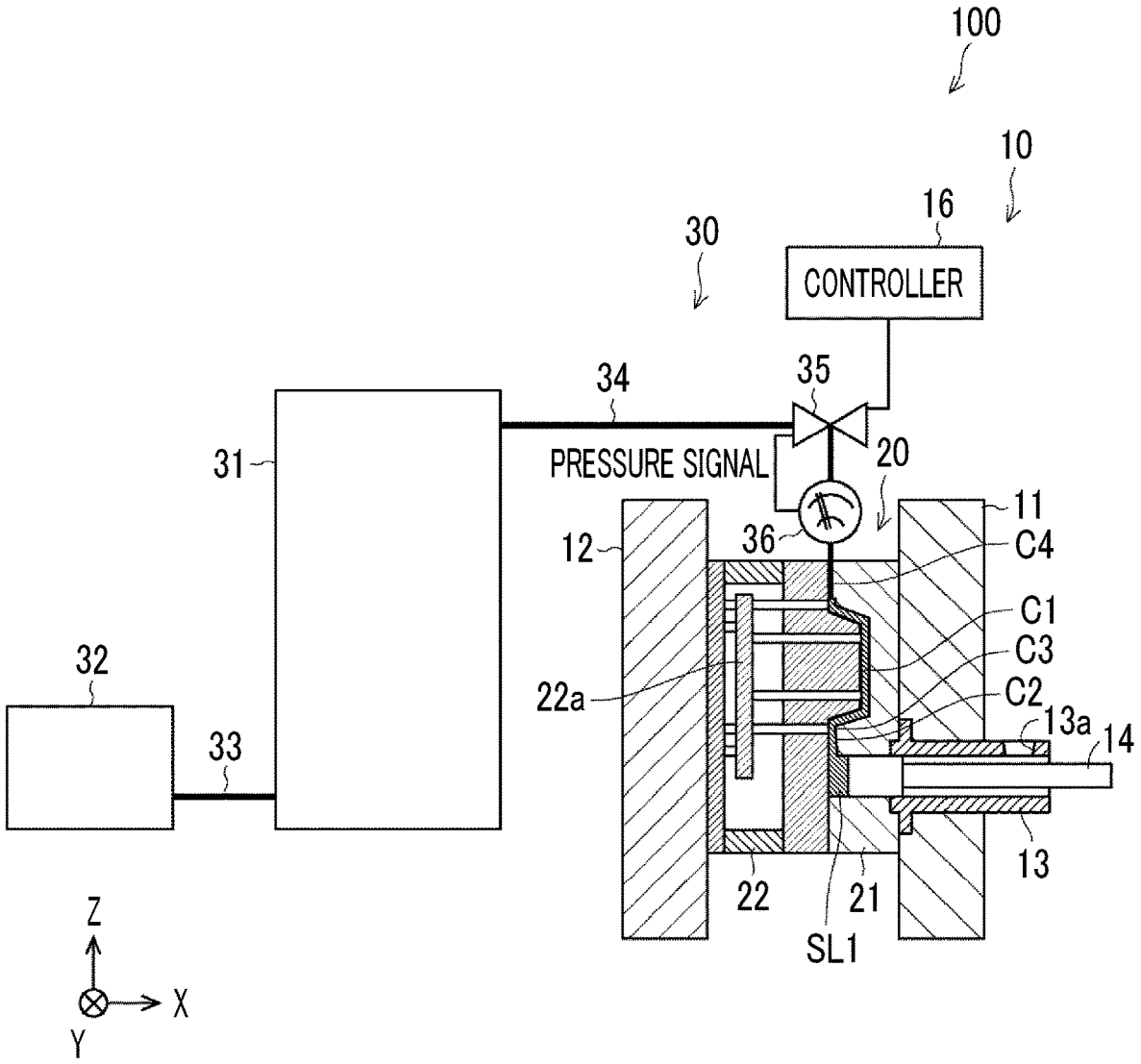
FIG. 1 is a schematic view of one configuration example of a casting apparatus that can be used in a casting method according to Embodiment 1.

A casting method according to Embodiment 1 will be described with reference to FIGS. 1 to 4. FIG. 1 is a schematic view of one configuration example of a casting apparatus that can be used in the casting method according to Embodiment 1.

It is needless to say that the right-handed xyz coordinates shown in FIG. 1 and other drawings are used for convenience in describing the positional relationship between components. Ordinarily, the positive z-axis direction is the vertical upward direction, and the xy plane is the horizontal plane, which is common among the drawings.

Apparatus

As shown in FIG. 1, a casting apparatus 100 includes a casting machine 10, a mold 20, and a pressurization unit 30. The casting method according to Embodiment 1 can be executed using the casting apparatus 100.

The casting machine 10 includes a fixed platen 11, a movable platen 12, a sleeve 13, a plunger rod 14, and a controller 16. The casting machine 10 may include a C frame, a hydraulic cylinder, a toggle, and an injection cylinder, which are not shown.

The fixed platen 11 is fixed at a predetermined position with the C frame or the like. The movable platen 12 is provided so as to approach and press the fixed platen 11 or disengage from the fixed platen using the hydraulic cylinder, the toggle, or the like.

The sleeve 13 is attached to the fixed platen 11. The plunger rod 14 is provided so as to be capable of sliding in the sleeve 13 in the axial direction (here, the X-axis direction) of the sleeve 13 with the injection cylinder, not shown. The sleeve 13 includes a molten metal supply port 13*a*. The sleeve 13 is supplied with molten metal through the molten metal supply port 13*a* with a ladle 15 or the like shown in FIG. 2.

The controller 16 generates signals for controlling the operation of the individual components of the casting machine 10, sends the generated signals to the individual components, and controls the components. The controller 16 may acquire a signal indicating the start of movement of the plunger rod 14, for example, at the time of injecting the molten metal in a casting step. The controller 16 may generate a signal indicating that the molten metal reaches a predetermined position in a cavity C1 and send the signal to a valve 35 according to, for example, the time that elapsed from the acquisition of the above-described signal. The predetermined position in the cavity C1 is a gate C3, a re-pressurization start position C1*c* described later (refer to FIG. 9), or the like.

The mold 20 includes a fixed mold 21 and a movable mold 22. The fixed mold 21 is attached to the fixed platen 11, and the movable mold 22 is attached to the movable platen 12.

When the movable mold 22 is pressed against the fixed mold 21, the cavity C1 is formed. The cavity C1 is a space having substantially the same shape as a cast product. The cavity C1 is connected to the inside of the sleeve 13 through a runner C2 and the gate C3. The sleeve 13, the runner C2, the gate C3, the cavity C1, and a part of a vent C4 are continuous so that the molten metal and gas are capable of passing through the components. The movable mold 22 and the fixed mold 21 may appropriately include an O-ring or packing in order to suppress the leakage of the gas in the cavity C1 through the contact surfaces of the movable mold 22 and the fixed mold 21.

The movable mold 22 includes an extrusion mechanism 22*a*. The extrusion mechanism 22*a* is provided so that an extrusion pin is capable of protruding toward the fixed mold 21 side.

The pressurization unit 30 includes a pressurization tank 31 and a compressor 32.

The compressor 32 is connected to the pressurization tank 31 through a flow path 33. The pressurization tank 31 may be connected to the outside of the cavity C1 except the sleeve 13 through a flow path 34. The outside of the cavity C1 except the sleeve 13 needs to be the outside of the connection portion between the sleeve 13 and the cavity C1 on the outer surface of the cavity C1. In addition, the outside of the cavity C1 except the sleeve 13 is, for example, a vent or an overflow. A plurality of vents may be provided, and the vent may be provided on the vent C4 side or on the gate C3 side in the cavity C1. Such a vent is preferably provided near a final loading portion in the cavity C1. The pressurization tank 31 according to Embodiment 1 is connected to the vent C4 through the flow path 34. The valve 35 and a pressure sensor 36 are provided in the flow path 34. The cavity C1 is connected to the flow path 34 through the vent C4. The valve 35 and the pressure sensor 36 are provided in this order from the pressurization tank 31 toward the vent C4 side.

The pressure sensor 36 detects the pressure of the gas in the cavity C1 through the flow path 33 and the vent C4. The pressure sensor 36 generates a pressure signal indicating the detection result of the pressure of the gas in the cavity C1 and sends this generated pressure signal to the valve 35 through a signal line. The pressurization tank 31 and the compressor 32 are connected to each other through the flow path 34.

The pressurization tank 31 stores a gas having a pressure higher than the pressure of the gas in the cavity C1. The pressure of the gas stored in the pressurization tank 31 needs to be the atmospheric pressure or higher. As such a gas, it is possible to use, for example, air or nitrogen gas. The compressor 32 sends a gas into the pressurization tank 31 through the flow path 34 to increase the pressure of the gas in the pressurization tank 31.

The valve 35 is opened and closed according to the signal acquired from the controller 16 or the pressure signal acquired from the pressure sensor 36. Specifically, a driving device, not shown, acquires the signal, and the driving device opens and closes the valve 35. The signal acquired from the controller 16 indicates the injection start time or time that elapsed from the injection start time. The time that elapsed from the injection start time is the time taken for the molten metal to reach a predetermined position in the cavity C1, specifically, the time taken for the part of the molten metal to pass through the gate, or the time taken for the molten metal to reach the final loading portion. The pressure signal acquired from the pressure sensor 36 indicates the pressure of the gas in the cavity C1.

When the valve 35 is opened, the gas in the pressurization tank 31 passes through the flow path 34 and the vent C4 and is sent into the cavity C1. That is, the gas in the cavity C1 is pressurized.

When the valve 35 is closed, it becomes impossible for the gas in the pressurization tank 31 to pass through the flow path 34 and the vent C4, and the sending of the gas in the pressurization tank 31 into the cavity C1 is stopped. That is, the pressurization of the gas in the cavity C1 is stopped. The pressurization unit 30 may include a valve different from the valve 35, and the gas in the cavity C1 may be released to the atmosphere by opening the different valve.

Casting Method

Figure 2:
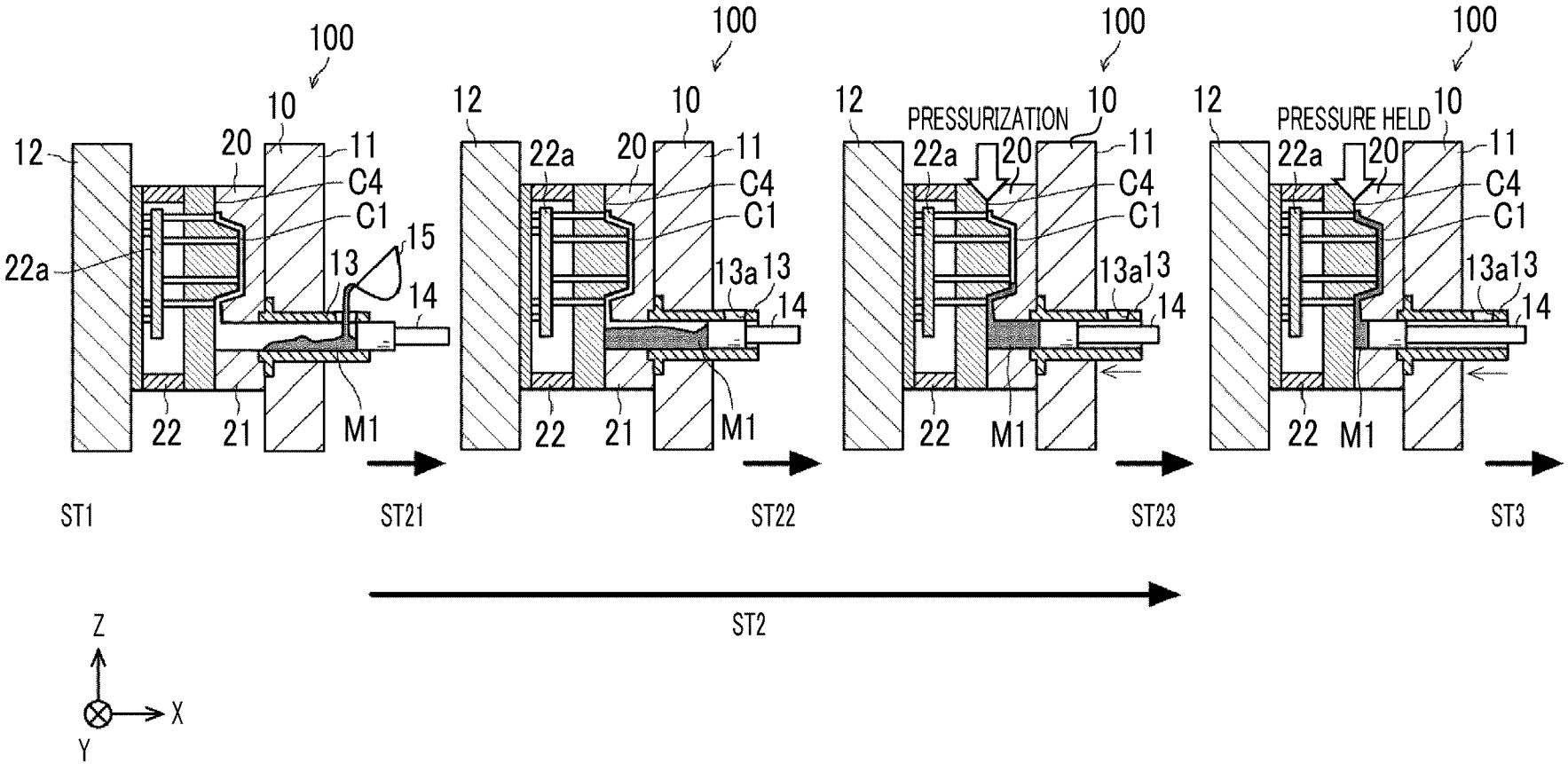
FIG. 2 is a schematic view of parts of an example of the casting method according to Embodiment 1.
Figure 3:
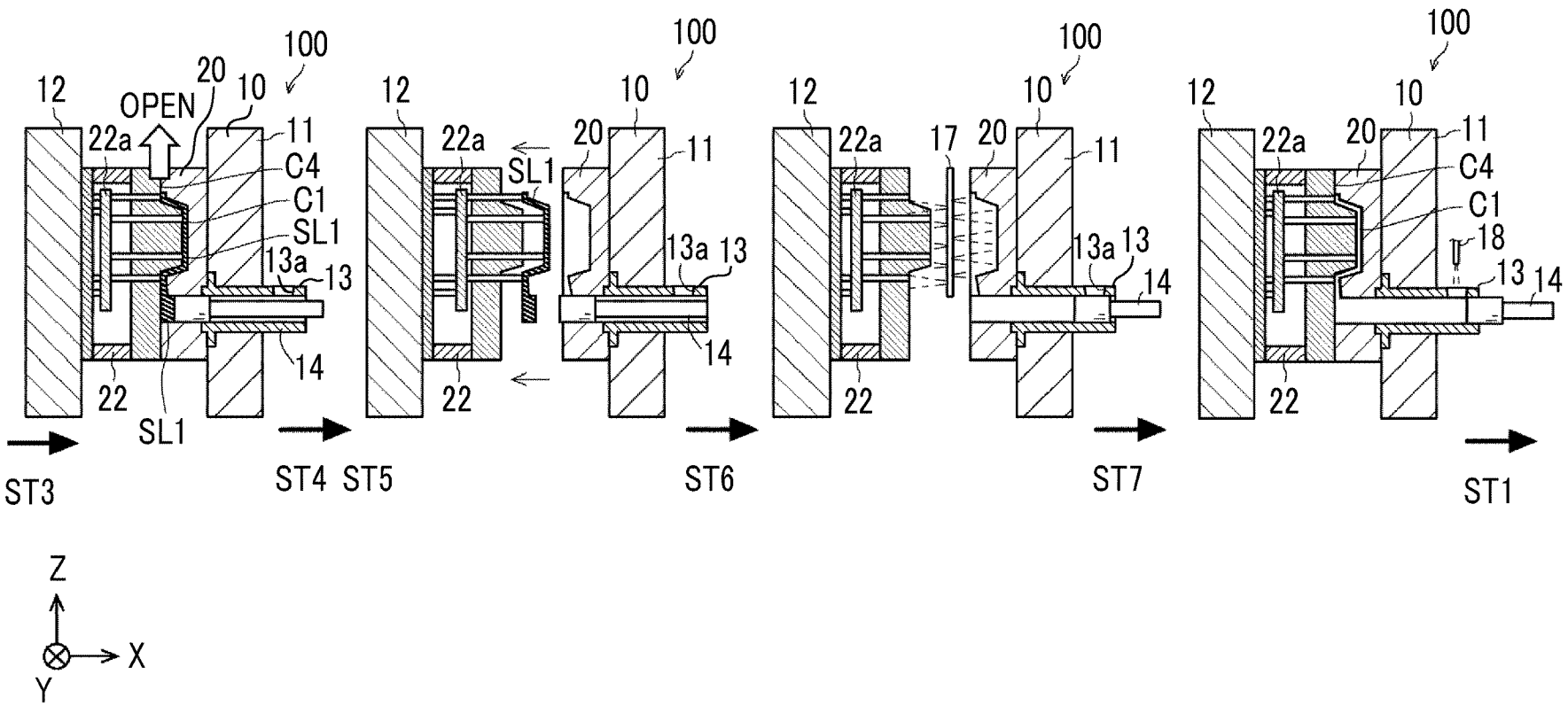
FIG. 3 is a schematic view of the remaining parts of the example of the casting method according to Embodiment 1.
Figure 4:
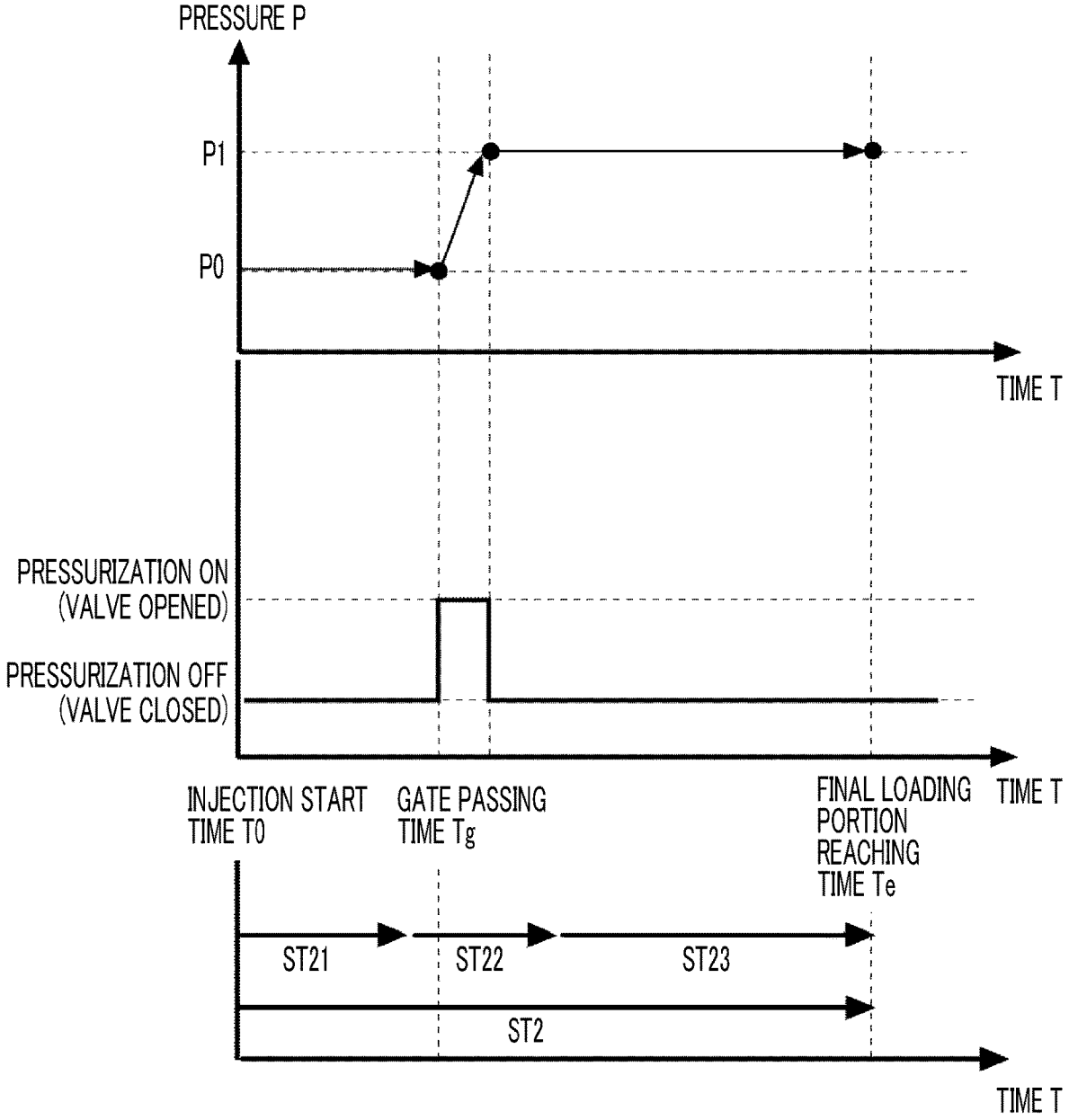
FIG. 4 shows an example of a chart showing pressure and pressurization ON/OFF with respect to time.

Next, an example of the casting method according to Embodiment 1 will be described with reference to FIGS. 2 to 4. In the example, the casting apparatus 100 is used. FIG. 2 and FIG. 3 are schematic views of parts of the example of the casting method according to Embodiment 1. FIG. 3 shows parts subsequent to the parts of the example of the casting method shown in FIG. 2. In FIG. 2 and FIG. 3, a part of the configuration of the casting apparatus 100 is omitted as appropriate for an easy view. FIG. 4 is an example of a chart showing pressure and pressurization ON/OFF with respect to time.

First, as shown in FIG. 2, molten metal M1 is supplied to the sleeve 13 using the ladle 15 (molten metal supply step ST1). The molten metal M1 is produced by melting a metal material and is preferably held in, for example, a holding furnace. As the metal material, it is possible to use a wide variety of pure metals or alloys. An example of the metal material is an aluminum alloy.

Subsequently, the plunger rod 14 is moved to the movable mold 22 side (here, the negative X-axis side), and the molten metal M1 is injected from the sleeve 13 into the cavity C1 of the mold 20 (injection step ST2).

Specifically, the movement of the plunger rod 14 is started (injection start step ST21). At an injection start time TO at which the movement of the plunger rod 14 is started, the plunger rod 14 is positioned rearward of the molten metal supply port 13*a* of the sleeve 13 in the traveling direction of the plunger rod 14 (here, the negative X-axis side). As shown in FIG. 4, the pressure of the gas in the cavity C1 is P0. The pressure P0 needs to be the atmospheric pressure or lower. The pressure P0 is, for example, 0.01 atm (=1013.25 Pa) or higher and 1.00 atm (=101325 Pa) or lower.

Subsequently, as shown in FIG. 2, the plunger rod 14 is continuously moved to the movable mold 22 side, and the tip part of the molten metal M1 passes through the gate C3 (gate passing step ST22). At a gate passing time Tg at which the tip part of the molten metal M1 passes through the gate C3, the valve 35 is opened, and the gas in the pressurization tank 31 is sent into the cavity C1 through the vent C4. As a result, the gas in the cavity C1 is pressurized. As shown in FIG. 4, at the gate passing time Tg, the valve 35 is opened (pressurization ON), and the pressure of the gas in the cavity C1 increases from P0 to P1. The pressure P1 needs to be the atmospheric pressure or higher. The pressure P1 is, for example, 1.00 atm or higher and 10.0 atm (=1013250 Pa) or lower and more preferably 2.50 atm (=253312.5 Pa) or higher and 7.50 atm (=759937.5 Pa) or lower. When the pressure of the gas in the cavity C1 reaches P1, the valve 35 is closed (pressurization OFF).

Furthermore, the plunger rod 14 is continuously moved to load the molten metal M1 into the cavity C1 (loading step ST23). From the increase in the pressure of the gas in the cavity C1 to P1 through a final loading portion reaching time Te at which the molten metal M1 reaches the final loading portion, the pressure of the gas in the cavity C1 is maintained at P1. After that, the gas in the cavity C1 may be released to the atmosphere as appropriate.

Subsequently, as shown in FIG. 3, the molten metal M1 is solidified to form a cast body SL1 (solidification step ST3). The valve 35 is closed to stop the sending of the gas into the cavity C1. After the molten metal M1 is solidified to a certain extent, the gas in the cavity C1 may be released using the different valve.

The movable mold 22 is moved to disengage from the fixed mold 21 and release the molds (mold releasing step ST4). The extrusion mechanism 22*a* extrudes the cast body SL1 from the movable mold 22 (extrusion step ST5). With the steps described above, the cast body SL1 can be manufactured. A cast product can be obtained from the cast body SL1 by removing an unnecessary part. In the cast body SL1 and the cast product, a number of holes are dispersed and miniaturized. Therefore, it is possible to suppress the generation of a blowhole, which acts as a defect in the cast product.

Subsequent to the extrusion step ST5, a mold release agent is applied to the fixed mold 21 and the movable mold 22 using a spray device 17 (mold release agent application step ST6), and a lubricant is supplied to the outer circumferential surface of the tip part of the plunger rod 14 using a lubricant supply device 18 (lubricant supply step ST7). Another cast body SL1 can be manufactured by returning to the molten metal supply step ST1 and carrying out again the injection step ST2 through the extrusion step ST5. That is, a large number of cast bodies SL1 can be continuously manufactured by repeating the molten metal supply step ST1 through the lubricant supply step ST7.

In addition, in the example of the casting method according to Embodiment 1 described above, the gas in the cavity C1 is pressurized at the gate passing time Tg or in the gate passing step ST22 shown in FIG. 4, but the gas in the cavity C1 may be pressurized after the plunger rod 14 passes through the molten metal supply port 13*a* of the sleeve 13 in the injection start step ST21. The gas in the cavity is preferably pressurized after the plunger rod 14 passes through the molten metal supply port 13*a* of the sleeve 13 since the gas in the cavity C1 does not leak through the molten metal supply port 13*a*.

Calculation Example

Figure 5:
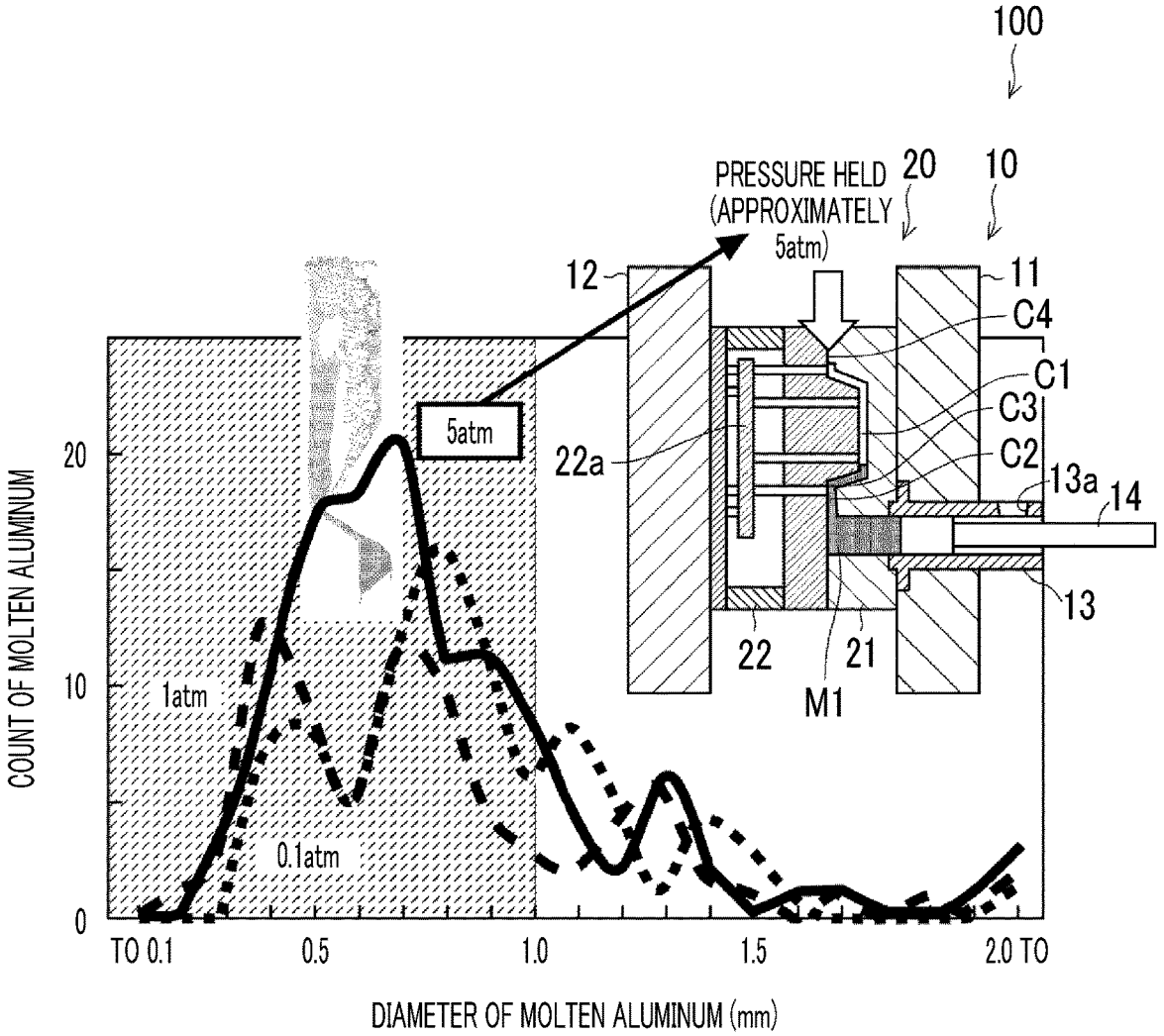
FIG. 5 is a graph showing a calculation example of the counts of molten aluminum with respect to the diameters of the molten aluminum.

Next, a calculation example will be described with reference to FIG. 5. FIG. 5 is a graph showing a calculation result of the counts of molten aluminum with respect to the diameters of the molten aluminum.

The calculation example is a calculation for the same casting method as the casting method according to Embodiment 1 described above except that the pressure P of the gas in the cavity C1 is constant in the injection step ST2 shown in FIG. 2. The calculation example was carried out using a computer aided engineering (CAE) analysis.

In the calculation example, as the molten metal, an aluminum alloy was used. In addition, as the pressure P of the gas in the cavity C1 in the injection step ST2, three pressures of 0.1 atm (=10132.5 Pa), 1 atm, and 5 atm (=506625 Pa) were used. In the calculation example, the diameters of the molten aluminum injected into the cavity C1 and the count (number) of the molten aluminum in the loading step ST23 were calculated. The calculation results are shown in FIG. 5.

As shown in FIG. 5, when the pressure P was 1 atm or 5 atm, the count of the molten aluminum having a diameter of 0 mm or larger and 1.0 mm or smaller was larger than the count of the molten aluminum when the pressure P was 0.1 atm. When the pressure P was 5 atm, the count of the molten aluminum having a diameter of 0 mm or larger and 1.0 mm or smaller was larger than the count of the molten aluminum when the pressure P was 1 atm. Therefore, when the pressure P is high, there is a tendency that a large number of molten aluminum having a small diameter are scattered in the cavity C1. Therefore, since a large number of molten aluminum having a small diameter are scattered, air bubbles having a high internal pressure are incorporated into the molten metal.

Figure 6:
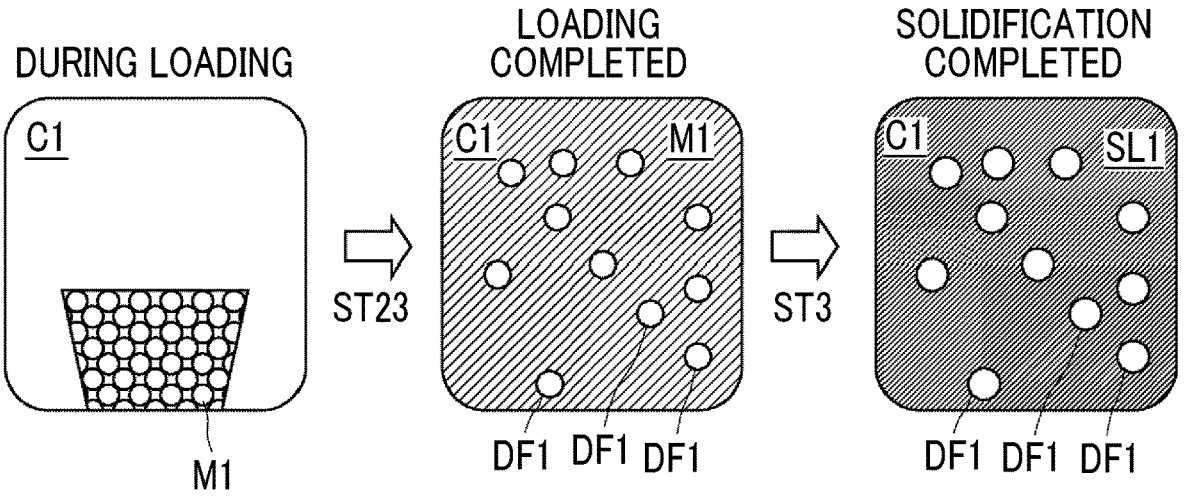
FIG. 6 is a schematic view of the behaviors of the molten aluminum in a cavity in the example of the casting method according to Embodiment 1.

Here, a solidification phenomenon considered to occur in the molten metal M1 in the solidification step ST3, which is based on the calculation example shown in FIG. 5, will be described with reference to FIG. 6. FIG. 6 is a schematic view of the behaviors of the molten aluminum in the cavity in the example of the casting method according to Embodiment 1. FIG. 6 shows the behaviors of the molten aluminum in the cavity in the loading step ST23 and the solidification step ST3.

As shown in FIG. 6, the molten metal M1 corresponding to the molten aluminum is loaded into the cavity C1. When the loading of the molten metal M1 into the cavity C1 is completed, a large number of air bubbles DF1 having a high internal pressure are generated in the molten metal M1. When the molten metal M1 is solidified, the cast body SL1 is formed. When the cast body SL1 is formed, the volume of the cast body SL1 is considered to become smaller than the volume of the molten metal M1 due to solidification shrinkage. However, a large number of the air bubbles DF1 have a high internal pressure and thus expand. Therefore, a large number of the expanded air bubbles DF1 compensate for pressure applied to the molten metal M1 that is solidifying. After the formation of the cast body SL1, a number of holes DF1 are dispersed and miniaturized in the cast body SL1. The air bubble DF1 in the molten metal M1 corresponds to the hole DF1 in the cast body SL1. The diameter of the hole DF1 is not large enough to affect the mechanical strengths of the cast body SL1 and cast products. Therefore, the hole DF1 is not a defect of the cast products. With this mechanism, it is possible to suppress the generation of a blowhole, which acts as a defect in the cast body SL1 and the cast products.

In addition, from the gate passing time Tg at which the part of the molten metal M1 passes through the gate C3 after the start of the injection step ST2, the gate passing step ST22 is started. In the gate passing step ST22, the pressure value of the gas in the cavity C1 is increased to the atmospheric pressure or higher. Therefore, from the point in time at which the part of the molten metal M1 passes through the gate C3, the gas starts to be sent into the cavity C1. As a result, at the point in time at which the molten metal M1 reaches the inside of the cavity C1, the pressure value of the gas in the cavity C1 is the atmospheric pressure or higher, and thus it is possible to reliably apply pressure to the molten metal. The vent C4 is provided near the final loading portion in the cavity C1, and the gas passes through the vent C4 to be sent into the cavity C1. Therefore, it is possible to increase the pressure value of the gas in the cavity C1 to the atmospheric pressure or higher until the molten metal M1 is loaded into the final loading portion, which is preferable.

Experiment

Figure 7:
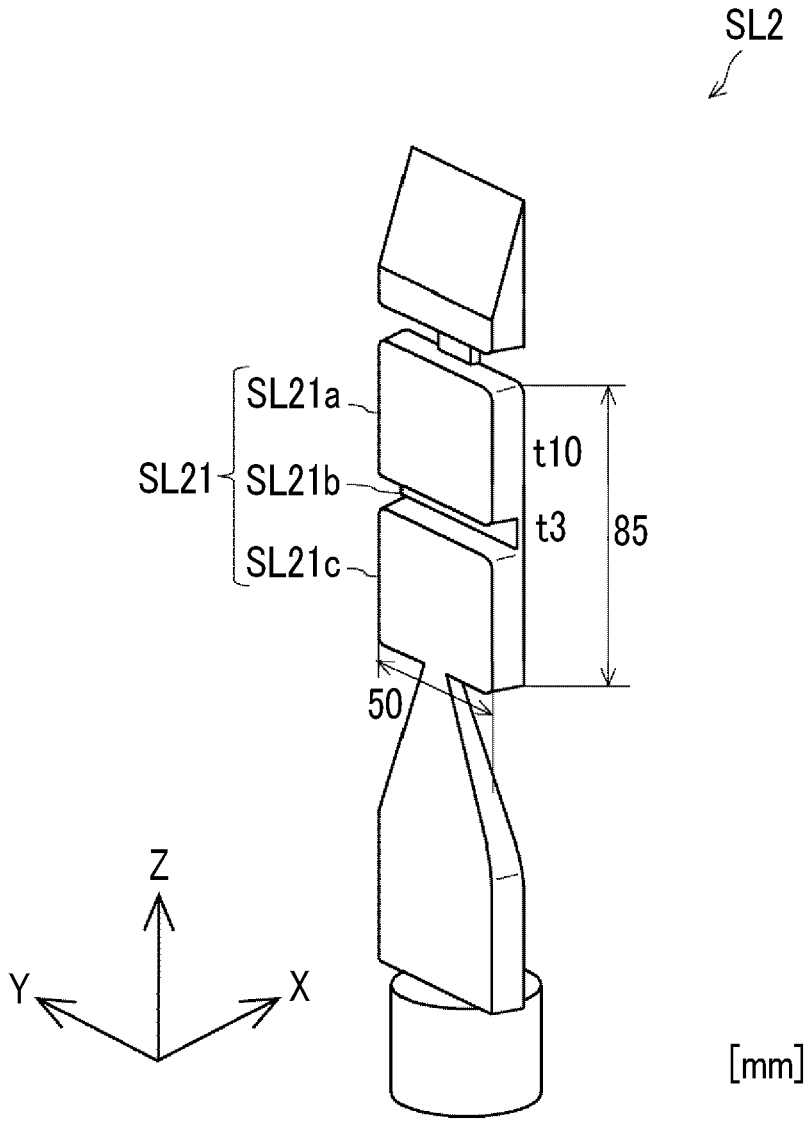
FIG. 7 is a perspective view of a test piece.
Figure 8:
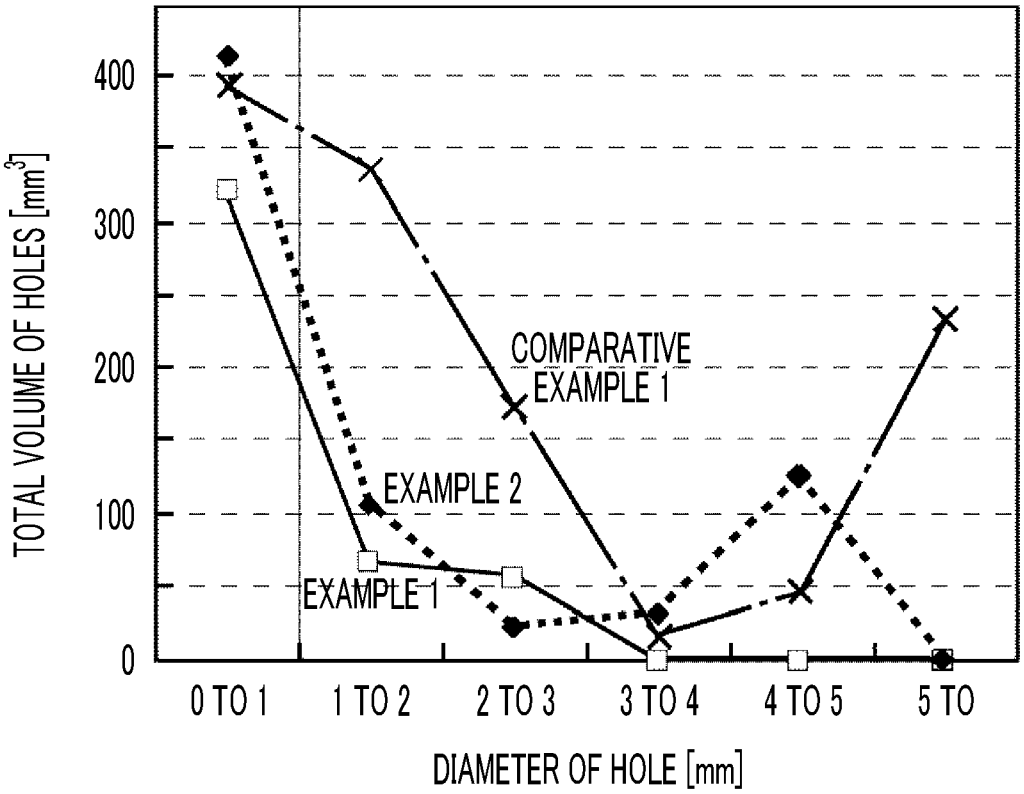
FIG. 8 is a graph showing the total volume of holes with respect to the diameters of the holes.

Next, an experiment will be described with reference to FIG. 7 and FIG. 8. The experiment is the result of evaluating a cast body SL2 shown in FIG. 2 that is manufactured using one specific example of the casting method according to Embodiment 1 described above. The cast body SL2 is a test piece. FIG. 7 is a perspective view showing the test piece. FIG. 8 is a graph showing the total volume of holes with respect to the diameters of the holes.

As shown in FIG. 7, the cast body SL2 includes a flat plate-shaped portion SL21. The flat plate-shaped portion SL21 includes a gate-side plate-shaped portion SL21*a*, a connection portion SL21*b*, and a vent-side plate-shaped portion SL21*c*. The gate-side plate-shaped portion SL21*a*, the connection portion SL21*b*, and the vent-side plate-shaped portion SL21*c* continue in this order. The gate-side plate-shaped portion SL21*a* is thicker than the connection portion SL21*b*. The cast body SL2 was formed using one specific example of the casting method according to Embodiment 1 described above.

In one specific example of the casting method according to Embodiment 1, molten aluminum was used as the molten metal. The speed of the plunger rod 14, that is, the injection speed was set to 1 m/sec. In Examples 1 and 2 and Comparative Example 1, the pressures P1 of the gas in the cavity C1 in the injection step ST2 were set to 5 atm, 1 atm, and 0.1 atm, respectively.

Holes in the flat plate-shaped portion SL21 were investigated. The investigation results are shown in FIG. 8. Here, a hole having a diameter of 1 mm or larger was evaluated as a defect, and a hole having a diameter of 0 mm or larger and smaller than 1 mm was not evaluated as a defect. This is because, when the diameter of a hole is 1 mm or larger, there is a possibility that the mechanical strength of the flat plate-shaped portion SL21 may decrease.

As shown in FIG. 8, the total volumes of holes having a diameter of 1 mm or larger in Examples 1 and 2 are smaller than the total volume in Comparative Example 1. The numbers of holes, which acted as defects, in the cast bodies SL2 according to Examples 1 and 2 were smaller than the number of holes in the cast body according to Comparative Example 1. One reason is that the pressures P1 in Examples 1 and 2 were higher than the pressure P1 in Comparative Example 1.

Modification Example

Figure 9:
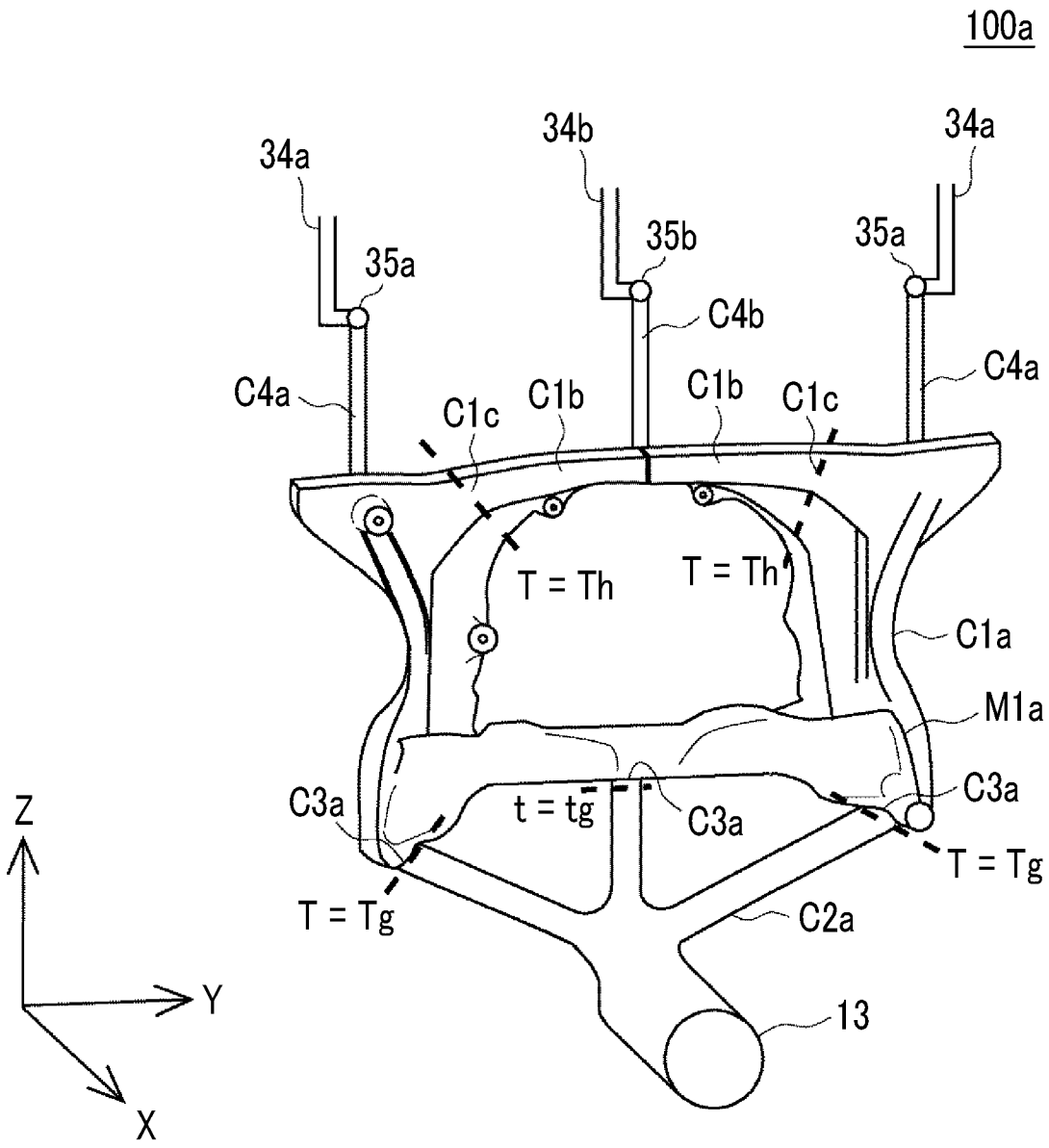
FIG. 9 is a perspective view of one step in a modification example of the casting method according to Embodiment 1.
Figure 10:
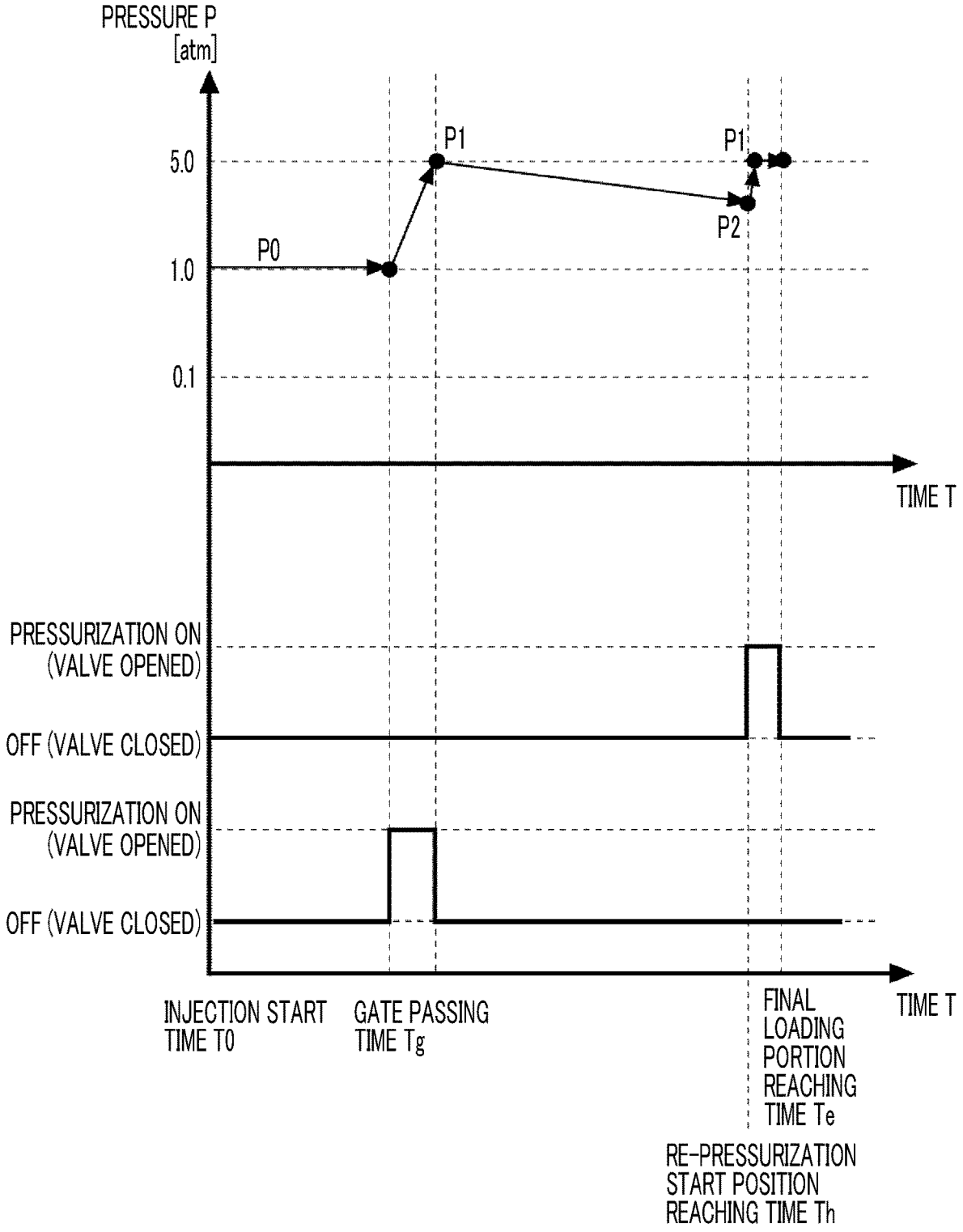
FIG. 10 is another example of the chart showing pressure and pressurization ON/OFF with respect to time.
Figure 11:
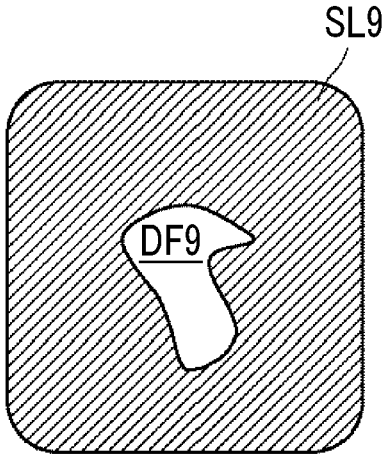
FIG. 11 is a schematic view of the behavior of the molten aluminum in a cavity in a casting method of a relevant technique.

Next, one modification example of the casting method according to Embodiment 1 will be described with reference to FIG. 9 and FIG. 10. FIG. 9 is a perspective view of one step in the one modification example of the casting method according to Embodiment 1. The one step shown in FIG. 9 corresponds to the loading step ST23. FIG. 10 is another example of the chart showing pressure and pressurization ON/OFF with respect to time.

The one modification example of the casting method according to Embodiment 1 is the same as the casting method according to Embodiment 1 described above except that a re-pressurization step ST221 for re-pressurizing again the gas in the cavity C1 is provided between the gate passing step ST22 and the loading step ST23. A cavity C1*a* has substantially the same shape as a suspension member, which is mounted in four-wheeled vehicles. A casting apparatus 100*a* that can be used in the one modification example of the casting method according to Embodiment 1 has the same configuration as the casting apparatus 100 shown in FIG. 1 except that the casting apparatus has a vent C4*b*, a valve 35*b*, and a flow path 34*b*. The other configuration of the casting apparatus 100*a* shown in FIG. 9 is one specific example of the configuration of the casting apparatus 100. The configuration of the casting apparatus 100*a* is not fully shown in FIG. 9 for the sake of easy understanding. Flow paths 34*a* and the flow path 34*b* are connected to the pressurization tank 31 shown in FIG. 1.

In the gate passing step ST22, at the gate passing time Tg at which the tip part of the molten metal M1*a* passes through the gates C3*a*, the valves 35*a* are opened, and the gas in the pressurization tank 31 is sent into the cavity C1*a* through the vents C4*a*. That is, the gas in the cavity C1*a* is pressurized. As shown in FIG. 10, at the gate passing time Tg at which the tip part of the molten metal M1*a* passes through the gates C3*a*, the valves 35*a* are opened (pressurization ON), and the pressure of the gas in the cavity C1*a* increases from P0 to P1. In this application example, the pressure P0 was set to 1.0 atm, and the pressure P1 was set to 5.0 atm. When the pressure of the gas in the cavity C1*a* reaches P1, the valves 35*a* are closed (pressurization OFF).

After the completion of the gate passing step ST22, the plunger rod 14 is further continuously moved, and, at a re-pressurization start position reaching time Th, the molten metal M1*a* is caused to reach a re-pressurization start positions C1*c*. The re-pressurization start positions C1*c* are positioned on the final loading portion side in the cavity C1*a*. The re-pressurization start positions C1*c* may be closer to the vent C4*b* than the gates C3*a* in the cavity C1*a*. The re-pressurization start position C1*c* is present, for example, between the vent C4*a* and the vent C4*b* in the cavity C1*a*. Here, the gas leaks to the outside of the cavity C1*a* from the gate passing time Tg through the re-pressurization start position reaching time Th. Therefore, as shown in FIG. 10, at the re-pressurization start position reaching time Th, the pressure P of the gas in the cavity C1*a* decreases to P2.

At the re-pressurization start position reaching time Th, the valve 35*b* is opened, and the gas in the pressurization tank 31 (refer to FIG. 1) is sent into final loading portion side portions C1*b* in the cavity C1*a* through the vent C4*b*. That is, the gas in the cavity C1*a* is re-pressurized (re-pressurization step ST221). The valve 35*a* is opened (pressurization ON), and the pressure of the gas in the cavity C1*a* increases from P2 to P1. After that, the valve 35*a* may be appropriately closed (pressurization OFF).

Furthermore, subsequently, similar to the casting method according to Embodiment 1 shown in FIG. 1 to FIG. 4, the loading step ST23 and the solidification step ST3 to the extrusion step ST5 are carried out. With the steps described above, it is possible to manufacture a cast body including a suspension member having substantially the same shape as the cavity C1*a*.

According to the one modification example of the casting method according to Embodiment 1 described above, even when the pressure of the gas in the cavity C1*a* decreases from the pressure P1 to P2 during a period from the gate passing time Tg to the re-pressurization start position reaching time Th, the gas in the cavity C1*a* is re-pressurized in the re-pressurization step ST221. Therefore, it is possible to maintain the pressure of the gas in the cavity C1*a* at a high pressure, and a gas that is compressed to higher than the atmospheric pressure is incorporated into the molten metal. Even when the volume of the molten metal M1*a* shrinks due to solidification, the pressure applied to the molten metal M1*a* does not easily decrease due to the expansion of the incorporated gas. Since it is possible to apply pressure to the entire molten metal M1*a*, the generation of a blowhole can be suppressed in the entire cast product.

In addition, in the gate passing step ST22 according to the one modification example described above, the gas in the cavity C1*a* is pressurized by sending the gas from the vents C4*a* that is closer to the gate side than the re-pressurization start positions C1*c* is. Therefore, since the gas is sent from the position that is closer to the gate C3*a* than the re-pressurization start position C1*c* is, it is possible to pressurize the gas from a position close to the molten metal M1*a* that has passed through the gate.

The present disclosure is not limited to the embodiment and can be modified as appropriate within the scope of the gist. In addition, the present disclosure may be carried out by appropriately combining the embodiment or one example thereof. For example, in the casting method according to Embodiment 1, an ordinary die casting method is used, but a casting method in which molten metal is pressurized by pressing a mechanical component against the molten metal may also be used. Examples of such a casting method include a die casting method or a squeeze casting method (high-pressure casting method) in which a squeeze pin is used.

What is claimed is:

1. A casting method comprising:

loading molten metal into a cavity from a sleeve; and sending a gas into the cavity from an outside of the cavity, except the sleeve, to pressurize a gas in the cavity and to increase a pressure value of the gas in the cavity to an atmospheric pressure or higher, wherein increasing the pressure value of the gas in the cavity to the atmospheric pressure or higher is started from a point in time at which a part of the molten metal passes through a gate after the loading of the molten metal into the cavity from the sleeve is started.

2. The casting method according to claim 1, further comprising re-pressurizing the gas in the cavity to increase again the pressure value of the gas in the cavity to the atmospheric pressure or higher from a point in time at which a part of the molten metal reaches a re-pressurization start position positioned on a final loading portion side in the cavity after increasing the pressure value of the gas in the cavity to the atmospheric pressure or higher is executed.

3. The casting method according to claim 2, wherein, in the increasing the pressure value of the gas in the cavity to the atmospheric pressure or higher, the gas in the cavity is pressurized by sending the gas from a position that is closer to the gate than the re-pressurization start position is.

* * * * *